US008136511B2

(12) United States Patent
Cushing

(10) Patent No.: US 8,136,511 B2
(45) Date of Patent: Mar. 20, 2012

(54) APPARATUS FOR REDUCING FUEL WAXING

(75) Inventor: Timothy J. Cushing, Howell, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 326 days.

(21) Appl. No.: 12/421,911

(22) Filed: Apr. 10, 2009

(65) Prior Publication Data

US 2010/0258091 A1 Oct. 14, 2010

(51) Int. Cl.
*F02G 5/00* (2006.01)
*F02G 5/04* (2006.01)

(52) U.S. Cl. ..... 123/557

(58) Field of Classification Search ..... 123/196 A, 123/298, 557; 210/144, 748.01, 748.02, 210/785, 184
See application file for complete search history.

(56) References Cited

U.S. PATENT DOCUMENTS

| | | | | |
|---|---|---|---|---|
| 4,105,004 | A * | 8/1978 | Asai et al. | 123/470 |
| 4,401,089 | A * | 8/1983 | Csaszar et al. | 123/536 |
| 4,411,240 | A | 10/1983 | Kravetz | |
| 4,500,475 | A * | 2/1985 | Csaszar et al. | 261/36.2 |
| 4,742,810 | A * | 5/1988 | Anders et al. | 123/538 |
| 4,984,550 | A * | 1/1991 | Toczyski et al. | 123/478 |
| 5,110,460 | A | 5/1992 | Gilas | |
| 2004/0191708 | A1 * | 9/2004 | Matoba et al. | 431/2 |
| 2006/0254133 | A1 * | 11/2006 | Rudolph et al. | 44/605 |
| 2010/0196208 | A1 * | 8/2010 | Makita et al. | 422/83 |

FOREIGN PATENT DOCUMENTS

JP 59215967 A * 12/1984

* cited by examiner

*Primary Examiner* — Mahmoud Gimie
(74) *Attorney, Agent, or Firm* — Cantor Colburn LLP

(57) ABSTRACT

A fuel filter is configured to filter fuel for an internal combustion engine and is associated with an electromagnetic wave generator configured to emit high frequency electromagnetic waves operable on the fuel to heat and thereby melt wax crystals suspended in the fuel.

20 Claims, 2 Drawing Sheets

APPARATUS FOR REDUCING FUEL WAXING

FIELD OF THE INVENTION

Exemplary embodiments of the present invention are related to a fuel supply system for an internal combustion engine and, more specifically, to an apparatus for preventing blockage of a fuel filter element due to wax crystallization of the fuel at low temperatures.

BACKGROUND

Fuels for internal combustion engines such as diesel fuel, kerosene, light oil, bio-fuels or a combination thereof may include a wax component that is subject to crystallization ("waxing") at temperatures below approximately −10 degrees Celsius. Suspended wax crystals can be trapped by or adhere to the filter media of a fuel filter resulting in partial or complete blockage of the fuel filter. Such blockage of the fuel filter may result in interruption of fuel flow to the engine resulting in a reduction of engine output or stalling of the engine.

Attempts to alleviate waxing problems inherent with such fuels have involved the application of heating elements in the fuel system supplying the engine. Such heating elements may include fuel tank or fuel line heaters as well as engine block heaters or heat exchangers. Recirculation of heated fuel from the fuel injection system to the fuel tank has also been utilized. While these and other methods for avoiding waxing of the fuel have met with some success, the devices utilize significant energy thereby reducing the efficiency of the engine, are costly and may not operate rapidly enough, especially following a cold engine start because the entire volume of fuel is subject to heating rather than directly addressing the wax crystals suspended therein.

Accordingly, it is desirable to provide an apparatus that is effective to eliminate obstruction of fuel filters caused by fuel wax crystallization and that is efficient and effective across the entire operational temperature range of the engine.

SUMMARY OF THE INVENTION

In one exemplary embodiment of the present invention, a fuel filter assembly for filtering fuel for an internal combustion engine comprises an electromagnetic wave generator configured to emit high frequency electromagnetic waves operable on the fuel to heat and thereby dissolve wax crystals suspended in the fuel.

In another exemplary embodiment of the present invention, a fuel system for an internal combustion engine comprises a fuel reservoir and a fuel pump configured to withdraw fuel from the fuel reservoir through a fuel conduit fluidly communicating the reservoir and the fuel pump. A fuel filter in fluid communication with the fuel conduit comprises a fuel manifold having a fuel inlet and a fuel outlet for receipt of fuel from the fuel conduit and return of fuel to the fuel conduit. An electromagnetic wave generator is associated with the fuel filter manifold and is configured to emit high frequency electromagnetic waves operable on the fuel to heat and thereby dissolve wax crystals suspended in the fuel.

In yet another exemplary embodiment of the present invention, a fuel system for an internal combustion engine comprises a fuel reservoir, a fuel pump for withdrawal of fuel from the fuel reservoir through a fuel conduit in fluid communication with the reservoir, and a fuel filter in fluid communication with the fuel conduit and comprising a fuel inlet and a fuel outlet for receipt of fuel from the fuel conduit and return of fuel to the fuel conduit. An electromagnetic wave generator is disposed adjacent to the fuel inlet to emit high frequency electromagnetic waves operable on the fuel to reduce wax crystals suspended therein.

The above features and advantages and other features and advantages of the present invention are readily apparent from the following detailed description of the best modes for carrying out the invention when taken in connection with the accompanying drawings.

BRIEF DESCRIPTION OF THE DRAWINGS

Other objects, features, advantages and details appear, by way of example only, in the following detailed description of embodiments, the detailed description referring to the drawings in which.

DESCRIPTION OF THE EMBODIMENTS

Figure 1:
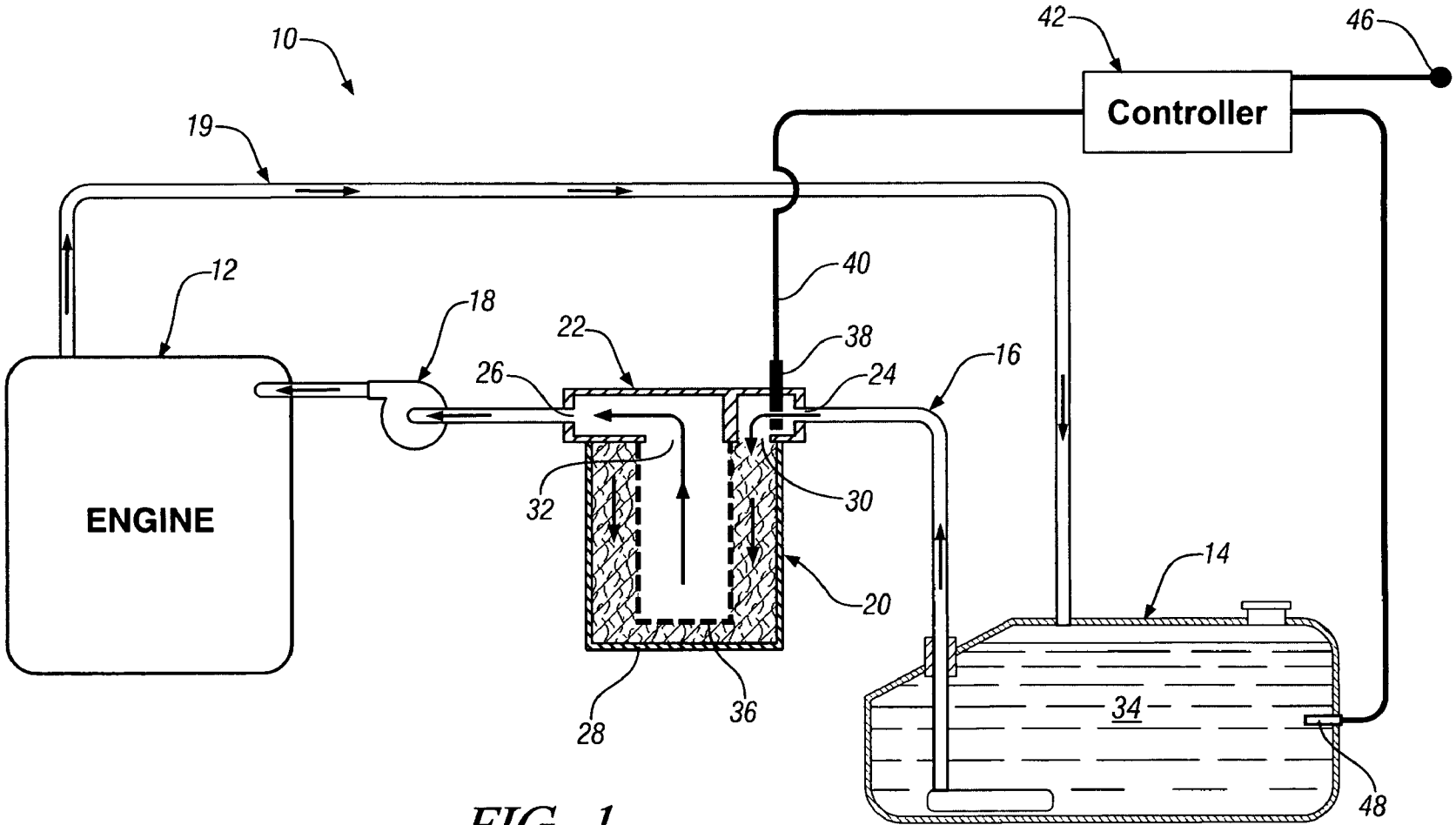
FIG. 1 is a schematic view of a fuel system for use with an internal combustion engine embodying the present invention.

In accordance with an exemplary embodiment of the present invention, a fuel system 10 for an in internal combustion engine, such as diesel engine 12, is illustrated in FIG. 1. The fuel system 10 comprises a fuel tank 14 and a fuel conduit 16 configured to transport fuel 34 from the fuel tank 14 to the various components of the fuel system 10. Associated with the fuel conduit is a fuel pump 18 that is configured to draw fuel 34 from the fuel tank 14 and to pressurize the fuel to a suitable level for injection into the diesel engine 12 by fuel injectors (not shown). A fuel return line 19 returns excess fuel from the fuel injectors to the fuel tank 14. Also associated with the fuel conduit 16 is a fuel filter assembly 20. The fuel filter assembly 20 may include a fuel manifold 22 having an inlet 24 and an outlet 26 in fluid communication with fuel conduit 16. A fuel filter housing 28 is configured for attachment to the fuel manifold 22 and has an inlet 30 and an outlet 32 for fluid communication with the inlet 24 and outlet 26 of the fuel manifold 22. The fuel filter housing 28 may be permanently attached to the fuel filter manifold 22 such as by welding or the like or it may be removable for easy replacement. When attached to the fuel manifold 22, the fuel filter housing 28 and associated inlet and outlets 24, 26 respectively, define a fuel passage for fuel 34 through the fuel filter assembly 20.

Disposed within the fuel filter housing 28 is a filter element 36. The filter element may be of a fibrous, paper, screen or other suitable configuration or material for removal of contaminants suspended in the fuel 34. The filter element 36 is disposed within the fuel filter housing 28 intermediate of the inlet 30 and the outlet 32 such that fuel 34 flowing through the fuel filter assembly 20 must pass through the filter element as it flows from the filter inlet 30 to the filter outlet 32.

In a non-limiting embodiment, an electromagnetic wave generator 38 is configured for installation in the fuel manifold 22. The electromagnetic wave generator is configured to emit high frequency electromagnetic waves when activated through via controller 42. In a non-limiting embodiment, the high frequency electromagnetic waves are in the microwave range that may include a range of about 0.3 GHz to about 300 GHz with a wavelength in the range about of 1 mm to about 1 m, with the actual frequency selected for effective heating of wax crystals suspended in the fuel, as is described in further detail below. The electromagnetic wave generator 38 is preferably installed adjacent to, or in close proximity with the inlet 24 of the fuel manifold 22 such that the high frequency electromagnetic waves operate on fuel 34 resident in the fuel manifold to heat and thereby dissolve or melt the wax crystals prior to their entry into the fuel filter housing 28. Due to the high power requirements required to generate waves in the microwave range, the electromagnetic wave generator may be placed in direct, fluid contact with the fuel 34 in the manifold 22 to improve the heating of the wax crystals suspended therein. The reduction of the wax crystals, via the high frequency electromagnetic waves emitted by the electromagnetic wave generator 38 prevents blockage of the fuel filter element 36, thereby allowing unrestricted flow of fuel 34 to the fuel system of the diesel engine 12. Application of electromagnetic radiation significantly reduces the heating time of the fuel to approximately 1 percent of that required using conventional, fuel heating methods. In addition, wax crystal reduction by directly heating the crystals is more direct since the method does not require heating of the liquid fuel in order to transfer heat to the wax crystals, as is the case with conventional fuel system heaters.

The operation of the electromagnetic wave generator 38, may be initiated by the controller 42, based upon a determination of the ambient temperature via temperature sensor 46, upon determination of the fuel temperature in the fuel tank 14 via temperature sensor 48, or via other conditions which may affect the stability of the fuel 34 with respect to the occurrence of waxing therein. If the controller 42 determines the fuel is at or below a predetermined temperature at which waxing of the fuel is likely to occur, the electromagnetic wave generator 38 is activated by the controller and the fuel crystals suspended in the fuel 34 entering the fuel filter assembly 20 are subjected to heating by the high frequency waves.

Figure 2:
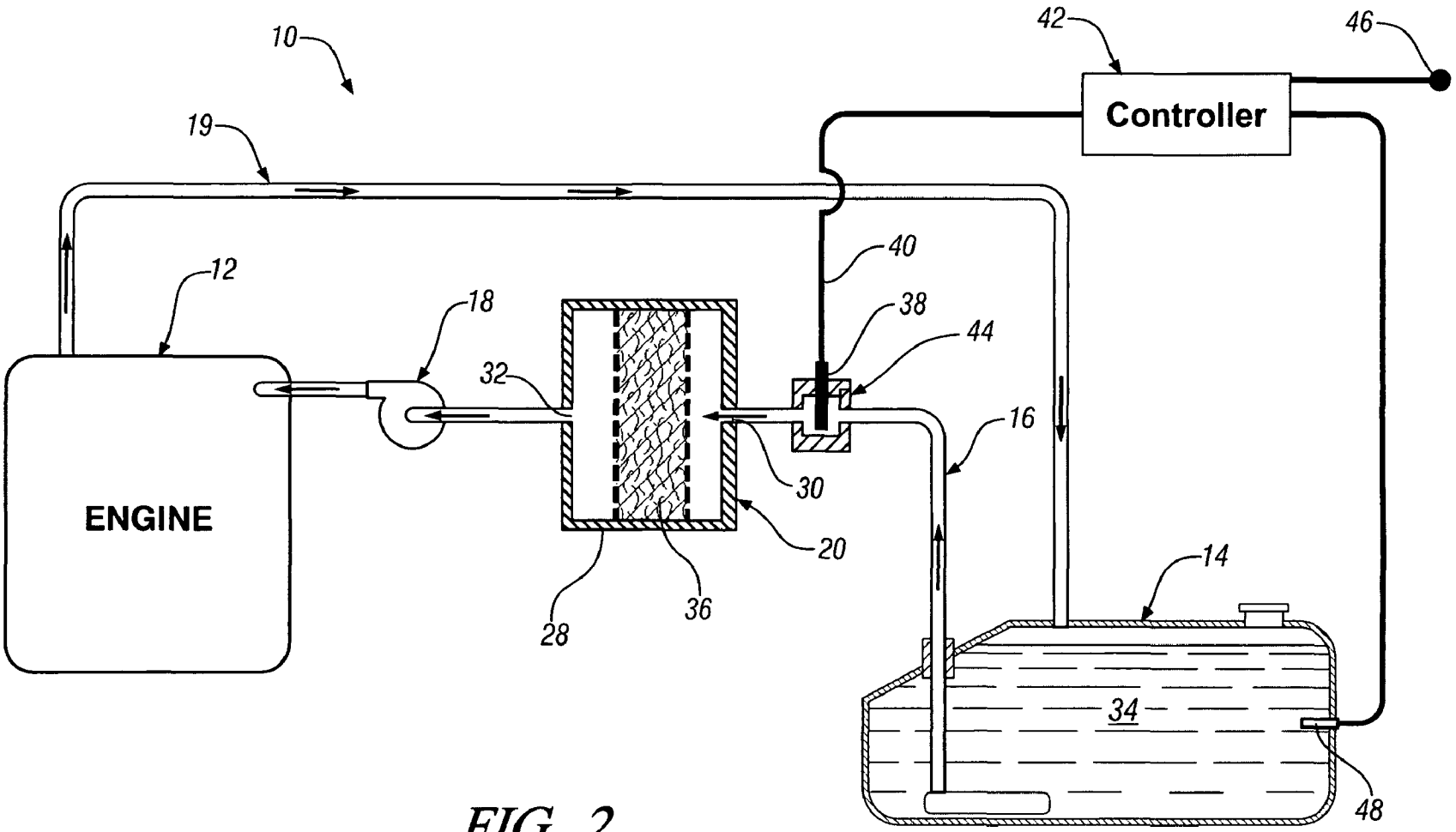
FIG. 2 is a schematic view of another embodiment of the fuel system a fuel system for use with an internal combustion engine embodying the present invention.

In another embodiment of the invention shown in FIG. 2, in which like numerals are used to denote like features already described, an electromagnetic wave generator 38 is configured for installation into a transducer manifold 44 associated with fuel conduit 16. The transducer manifold 44 is preferably located in close, upstream proximity to the inlet 30 of fuel filter housing 28. As indicated, electromagnetic wave generator is configured to emit high frequency electromagnetic waves when activated through via controller 42. In a non-limiting embodiment, the high frequency electromagnetic waves are in the microwave range that may include a range of about 0.3 GHz to about 300 GHz with a wavelength in the range about of 1 mm to about 1 m, with the actual frequency selected for effective heating of wax crystals suspended in the fuel. The high frequency electromagnetic waves operate on fuel 34 resident in transducer manifold 44, directly upstream of the inlet 30 of the fuel filter housing 28 to heat and thereby reduce or dissolve wax crystals suspended in the fuel prior to their entry into fuel filter 20. The reduction of the wax crystals, via heating by the high frequency waves emitted by the electromagnetic wave generator 38 prevents blockage of the fuel filter element 36 thereby allowing unrestricted flow of fuel 34, to the fuel system of the diesel engine 12.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiments disclosed as the best mode contemplated for carrying out this invention, but that the invention will include all embodiments falling within the scope of the present application.

What is claimed is:

1. A fuel filter assembly for filtering fuel for an internal combustion engine comprising;

an electromagnetic wave generator positioned in a fuel flow path and configured to emit high frequency electromagnetic waves that are operable on the fuel to heat and thereby dissolve wax crystals suspended in the fuel.

2. The fuel filter assembly for filtering fuel for an internal combustion engine of claim 1, wherein the high frequency electromagnetic waves are in the microwave range.

3. The fuel filter assembly for filtering fuel for an internal combustion engine of claim 1, further comprising;

a controller configured to initiate operation of the electromagnetic wave generator based upon conditions affecting the stability of the fuel.

4. The fuel filter assembly for filtering fuel for an internal combustion engine of claim 3, wherein the conditions affecting the stability of the fuel include ambient temperature.

5. The fuel filter assembly for filtering fuel for an internal combustion engine of claim 3, wherein the conditions affecting the stability of the fuel include fuel temperature.

6. The fuel filter assembly for filtering fuel for an internal combustion engine of claim 1, further comprising a fuel filter manifold having the electromagnetic wave generator disposed therein.

7. The fuel filter assembly for filtering fuel for an internal combustion engine of claim 1, wherein the high frequency electromagnetic waves have a frequency of about 0.3 GHz to about 300 GHz with a wavelength in the range of about 1 mm to about 1 m.

8. The fuel filter assembly of claim 1, further comprising:

a fuel filter housing having a filter element disposed therein, the filter housing and filter element configured to receive fuel that has been heated by the electromagnetic wave generator.

9. A fuel system for an internal combustion engine comprising;

a fuel reservoir;

a fuel pump configured to withdraw fuel from the fuel reservoir through a fuel conduit fluidly communicating the reservoir and the fuel pump;

a fuel filter in fluid communication with the fuel conduit comprising a fuel filter manifold having a fuel inlet and a fuel outlet for receipt of fuel from the fuel conduit and return of fuel to the fuel conduit; and an electromagnetic wave generator associated with the fuel filter manifold configured to emit high frequency electromagnetic waves directly operable on the fuel to heat and thereby dissolve wax crystals suspended in the fuel.

10. The fuel system for an internal combustion engine of claim 9, further comprising;

a controller configured to initiate operation of the electromagnetic wave generator based upon conditions affecting the stability of the fuel.

11. The fuel system for an internal combustion engine of claim 10, wherein a condition affecting the stability of the fuel includes ambient temperature.

12. The fuel system for an internal combustion engine of claim 10, wherein a condition affecting the stability of the fuel includes fuel temperature.

13. The fuel system for an internal combustion engine of claim 9, wherein the high frequency electromagnetic waves are in the microwave frequency range of about 0.3 GHz to about 300 GHz with a wavelength in the range of about 1 mm to about 1 m.

14. The fuel system of claim 9, wherein the electromagnetic generator is positioned upstream from the fuel filter, such that the fuel filter is configured to receive fuel that has been heated by the electromagnetic wave generator.

15. A fuel system for an internal combustion engine comprising;

a fuel reservoir;

a fuel pump configured to withdraw fuel from the fuel reservoir through a fuel conduit fluidly communicating the reservoir and the fuel pump;

a fuel filter in fluid communication with the fuel conduit comprising a fuel inlet and a fuel outlet for receipt of fuel from the fuel conduit and return of fuel to the fuel conduit; and an electromagnetic wave generator disposed in a fuel flow path adjacent to the fuel inlet and configured to emit high frequency electromagnetic waves operable on the fuel to heat wax crystals suspended in the fuel.

16. The fuel system for an internal combustion engine of claim 15, further comprising;

a fuel manifold, configured to receive the electromagnetic wave generator therein, located upstream of the fuel filter and in fluid communication with the fuel conduit.

17. The fuel system for an internal combustion engine of claim 15, further comprising;

a controller configured to initiate operation of the electromagnetic wave generator based upon conditions affecting the stability of the fuel.

18. The fuel system for an internal combustion engine of claim 17, wherein a condition affecting the stability of the fuel includes ambient temperature.

19. The fuel system for an internal combustion engine of claim 17, wherein a condition affecting the stability of the fuel includes fuel temperature.

20. The fuel system for an internal combustion engine of claim 15, wherein the electromagnetic wave generator is operable to emit electromagnetic waves in the microwave range.

* * * * *